US005205731A

United States Patent [19]

Reuther et al.

[11] Patent Number: 5,205,731

[45] Date of Patent: Apr. 27, 1993

[54] NESTED-FIBER GAS BURNER

[75] Inventors: James J. Reuther, Worthington; Robert D. Litt, Columbus, both of Ohio

[73] Assignee: Battelle Memorial Institute, Columbus, Ohio

[21] Appl. No.: 837,872

[22] Filed: Feb. 18, 1992

[51] Int. Cl.[5] ..... F23D 14/12

[52] U.S. Cl. ..... 431/328; 431/7

[58] Field of Search ..... 431/328, 329, 7

[56] References Cited

U.S. PATENT DOCUMENTS 3,173,470 3/1965 Wright ..... 431/328
4,850,862 7/1989 Bjerklie .
4,861,261 8/1989 Krieger .
4,878,837 11/1989 Otto .
4,890,601 1/1990 Potter .
4,895,513 1/1990 Subherwal .
4,977,111 12/1990 Tong et al. .
5,088,919 2/1992 De Bruyne et al. ..... 431/328

*Primary Examiner*—Carroll B. Dority
*Attorney, Agent, or Firm*—Sidney W. Millard

[57] ABSTRACT

A nested fiber gas burner is formed with a burner body having an inlet on one end and a burner port on the other end. A mat of fibers is formed from discrete fibers of material randomly deposited into a mold having the general configuration of the burner port. After the fibers are deposited in the mold to a depth of about 0.5 inch, they are heated to a temperature of about 1200° C. for about two hours, which causes the fibers to bond together. Thus bonded, the fiber mat is secured in place in the burner port.

17 Claims, 2 Drawing Sheets

NESTED-FIBER GAS BURNER

FIELD OF THE INVENTION

This invention relates to gas burners, their method of making and their method of use.

BACKGROUND OF THE INVENTION

The present invention relates to the improved combustion of natural gas, propane and other gaseous fuels by the use of an innovative burner technology which generates a singular type of flame that combines the advantages and eliminates the disadvantages of current premixed burner technologies.

In the state of the art, the following are accepted by combustion engineers as two separate and distinct types of flames:

A. Blue flames, or open combustion, and

B. Radiant flames, or subsurface combustion.

Simply put, a burner is a physical interface, consisting of one or more orifices, intended to separate and position incoming unburned flammable gas and air from subsequent combustion. Ported burners differ from porous-matrix ones in the location wherein the flame is positioned. Ported burners allow natural gas flames (which are naturally blue in color) to stabilize (and appear) outside of the burner assembly, in the open, whereas with porous burners, flames are stabilized inside the matrix and are not visible, but which impart heat to the matrix, which glows red hot, or radiates.

Prior to about a decade ago, preference for one type of burner technology over the other was determined almost solely by heat-transfer considerations, and not, for example, by any environmental consideration. Increased concern about the impact of natural gas and synthetic fuel combustion on the quality of either the outdoor or the indoor air dramatically changed this situation, especially when the following result was discovered: porous, radiant burners emit only about 10% of the nitrogen oxides, $NO_x$ ($NO+NO_2$), of ported, blue-flame burners.

This environmentally beneficial attribute did not come without penalty, as it was discovered that port loading (energy released per unit area per unit time) of a typical radiant, porous-matrix burner was only about 2% to about 5%, or less, of that of a ported, blue-flame burner (1,000 vs. 20,000 to 50,000 Btu/in.$^2$-hr).

SUMMARY OF THE INVENTION

In trying simultaneously to solve problems of fuel efficiency and environmental quality which are becoming more and more critical in recent times, a hybrid technology has been developed incorporating the best characteristics of the blue-flame burner and the radiant panel burner, wherein a fibrous mat is secured in the burner port and the operating parameters of the burner are controlled by valving structure to control fuel firing rate, fuel/air ratio, primary aeration and excess aeration to cause the leading edge of the flame front to exist within the nested fiber mat.

To achieve the desired results, the mat is constructed in a unique way to have unique characteristics and dimensions and to operate in a unique fashion.

Fibers are formed having a length of about 0.3 in. to about 0.7 in. and having a diameter in the range between about 0.008 in. and 0.03 in. The way these lengths and diameters are achieved is not a part of this invention, but they may be formed by the melt extraction process well known in the industry, and in those cases, the term "diameter" is slightly misleading, because the resulting fibers are not necessarily cylindrical. As used in this patent, the term "diameter" is a relative term used to define the largest transverse dimension of the fiber. Fiber dimensions may be adjustable outside the preferred range as stated above so long as the void percentage of 80–89% is maintained as discussed subsequently including the random orientation of the fibers.

Fibers are deposited in a mold having some predetermined shape corresponding generally to the shape of the burner housing into which the final mat is to be installed. The fibers are randomly deposited in the mold to provide a thickness of about 0.3 in. to about 0.7 in., and the random deposit of the fibers in the mold provides an aspect ratio in the range of about 15 to about 50. For purposes of this patent, the term "aspect ratio" means the ratio of the fiber length to its diameter.

In the mold, the fibers are heated to a temperature of about 1000° C. to about 1500° C., preferably about 1200° C. with 310 stainless steel or about 1225° C. for 304 stainless steel, for a period of about two hours, and then are allowed to cool to atmospheric temperature. Inspection of the resulting mat reveals that the fibers have bonded together to provide a sintered structure which is achieved without the application of binders or pressure to the fibers during the heating process.

The temperature used in the sintering operation depends upon the melting point of the fiber in question, and the composition of the fiber, in turn, depends upon the anticipated burning rate and temperature of the gas to be burned by the burner. Suitable materials from which fibers may be formed are: stainless steel, iron-chromium-aluminum electrical-resistance alloys (known under the trademark Kanthal), nickel/chrome, FeCrAlY (known under the trademark Fecralloy) and other metallic or ceramic materials of a similar nature. The most preferred fiber material is 310 stainless steel.

The resulting sintered mat should have a void percentage in the range of about 80% to about 89% such that pressure drop across the mat when installed in the burner housing should be no more than about 0.3 in. of water, when the port loading is up to about 5,000 Btu/in.$^2$-hr.

Objects of the invention not clear from the above will be fully understood by a review of the drawings and the description of the preferred embodiment which follows.

DESCRIPTION OF THE PREFERRED EMBODIMENTS

According to recent research, a natural-gas burner is needed that has all of the following design and performance characteristics:

A. Low cost (less than $65/100 KBtu/hour)

B. High port loading (greater than 1 KBtu/hour-square inch)

C. Low pressure drop (less than 0.5 inch water)

D. High turndown ratio (greater than 2:1)

E. Low $NO_x$ emissions (less than 20 ppm, $O_2$-free)

F. Low $NO_2$ fraction in $NO_x$ (less than 10%)
G. Low CO emissions (less than 100 ppm, $O_2$-free)
H. Low HC emissions (less than 10 ppm, $O_2$-free)
I. Low excess air operation (less than 10%)
J. Short flame length (less than 4 inches)
K. High scalability (greater than 10:1)

The state of the art, which establishes the baseline characteristics listed above, is the radiant-surface ceramic-fiber matrix power burner described in Pat. No. 4,977,111. Although state of the art, some of these characteristics are prohibitive from a cost standpoint, which is why the burner has achieved limited success, to date. For example:

(1) the pressure drop of the burner sometimes causes it to operate much like a filter, which results in plugging, failure, and accidents,
(2) the turndown ratio reflects an inherent flashback problem, and
(3) the cost is usually only economical if environmental regulations force the user into buying burners with low $NO_x$ emissions.

The burner design concept used by the radiant surface fiber matrix is certainly not new, as examples are nearly a century old and common. The described burner of Pat. No. 4,977,111 achieved state of the art status by incorporating advanced materials into this proven burner design concept.

Figure 1:
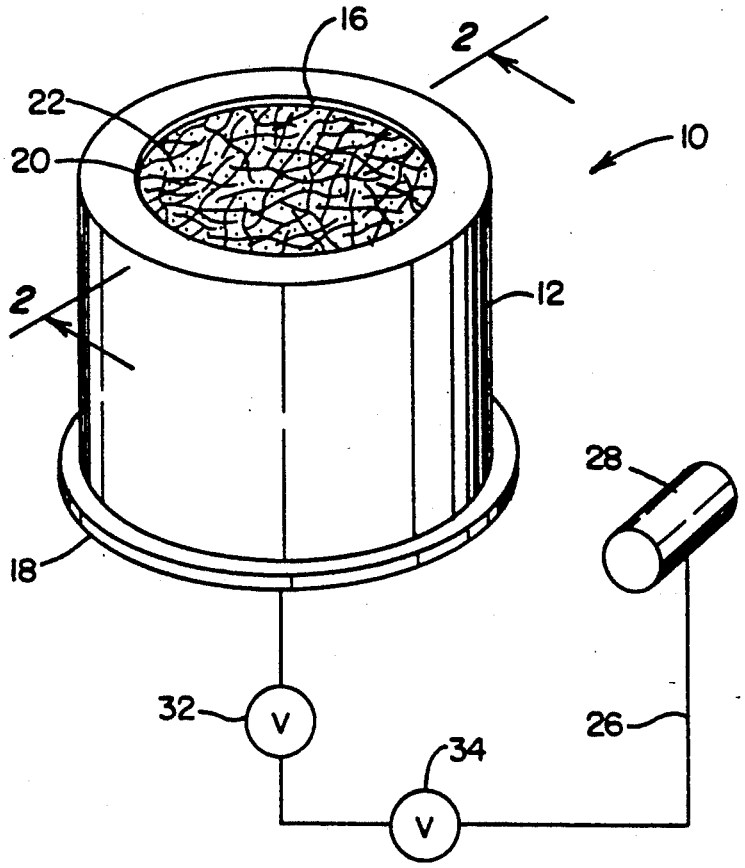
FIG. 1 is a schematic perspective view of a burner according to this invention.
Figure 2:
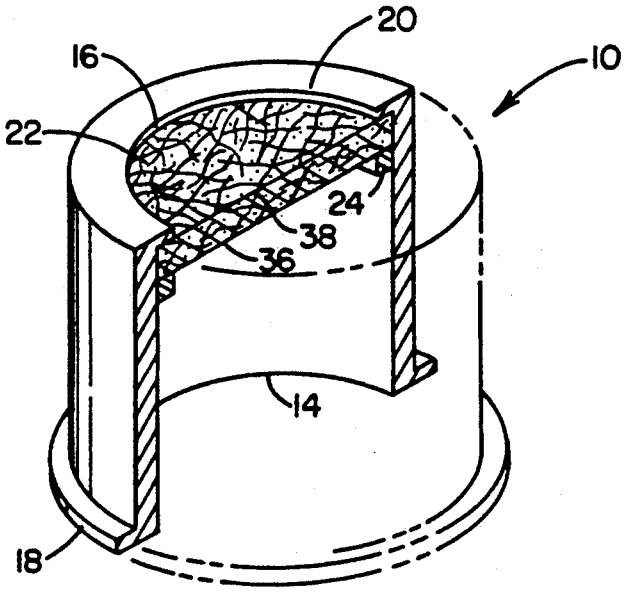
FIG. 2 is a sectional view of the burner of FIG. 1 taken along line 2—2.
Figure 3:
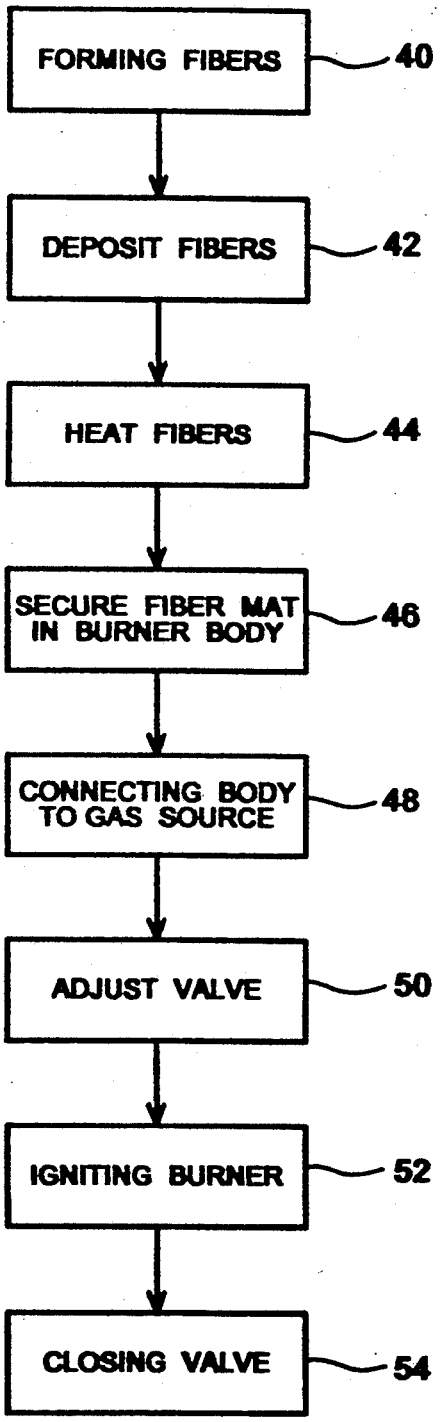
FIG. 3 is a diagrammatic view of the procedural steps used for making and using the burner of this invention.

To achieve the desired operating characteristics described above, the burner of this invention as illustrated in FIGS. 1 and 2 is constructed and operated according to the procedural steps broadly illustrated in FIG. 3. Looking particularly to FIG. 1, a burner 10 includes a body 12 having an inlet 14 at one end and a burner port 16 at the other end. The elongated body 12 is merely illustrative of a burner which may be useful for burning domestic natural gas where the elongated body allows for a premixing of gas and air before it begins to exit burner port 16.

The lower end of the body 12 may have a radially outwardly extending flange 18 to provide a gas seal where it is joined to the gas feed. A radially inwardly extending flange 20 at the burner port 16 serves two functions. It provides both dimensional stability for the burner and a shoulder to engage a fibrous mat 22 secured in place in the port by a ring 24 which may be welded into place after the mat 22 is inserted into position. There are other ways of securing mat 22 in operative position at port 16, and any such alternate ways are well within the concept of the herein disclosed invention. The welded ring 24 is merely one illustrated means which has proved effective. Indeed one preferred embodiment is to have burner body 12 serve as the mold and the fibrous mat could be sintered in place without any additional bonding between the body and the mat.

Structure for closing the lower end or inlet 14 of burner body 12 to prevent leakage of the gas/air mixture from the body is not illustrated, because such is well known in the art. The burner is connected by suitable tubing 26 to a source 28 of combustible gas. The tubing 26 delivers gas to burner body 12. Premixing of gas and air by an auxiliary fan is preferred but a conventional venturi system may be a useful alternative.

Two valves 32 and 34 are illustrated as being in feed line 26 and valve 32 serves the purpose of turning the gas on and off. Valve 34 serves the function of controlling the flow rate of gas from the source 28 to the degree that when valve 32 is in its full open position, the leading edge of the flame front of the ignited gas/air mixture is held within the fiber mat 22 intermediate its inner surface 36 and its outer surface 38. Desirably, blue flame projects from mat 22 for a short distance. The controlling features of valve 34 must take into account the void percentage, aspect ratio and thickness of the mat 22. The operating parameters must be taken into consideration and valve 34 adjusted to control the delivery of gas such that the leading edge of the flame front remains within the fiber mat to achieve the desired results.

Ported burners normally differ from porous-matrix burners in the appearance of the flame and in the location wherein the flame is positioned. Ported burners are typically operated such that natural gas flames stabilize outside of the burner assembly and appear blue, whereas porous burners are typically operated such that natural gas flames stabilize within the matrix, making them not directly visible, but manifest by the radiance of the matrix, which glows red to yellow in color.

As stated above, prior to about a decade ago preference for one type of burner technology over the other was determined almost solely by heat-transfer considerations, and not, for example, by any environmental consideration. Increased concern about the impact of natural gas combustion on the quality of either the outdoor or the indoor air has dramatically changed this situation, especially when it was discovered that porous, radiant burners typically emitted only about 10% of the nitrogen oxides, $NO_x$ ($NO+NO_2$), of ported blue-flame burners. Additionally, port loading of a typical radiant, porous-matrix burner was less than about 2% to about 5% of that of a ported, blue-flame burner (about 1 vs. 20 to 50 KBtu/in.$^2$-hr).

Porous radiant burners, therefore, had to be much larger (at least ~20x) in surface area to release an equivalent amount of energy upon combustion, which is one reason why this type of burner is more expensive than a blue-flame one. Greater manufacturing cost is another reason why porous-matrix burners are not as economically competitive as ported burners.

This invention eliminates this aforementioned compromise by providing a nested-fiber gas burner which is operated to produce a blue flame with the low $NO_x$ emissions (<20 ppm) of a radiant burner, while achieving port loadings that are about eight to ten times higher than those of the best radiant burner.

This attribute is perhaps the most distinguishing feature of the invention, given the state of the understanding with regard to burner design for $NO_x$ control during natural gas combustion. The nested-fiber burner of this invention allows natural gas to be burned with a port loading approaching that of ported burners, and a cleanliness approaching that of porous-matrix burners.

The nested fiber burner technology performs as it does because of the unique features allowed only by specific techniques for "fiber-nest building", namely, by careful selection of aspect ratio, void percentage, mat thickness, and pore size. Nests of fibers are manufactured that allow the combustion of natural gas to occur not completely outside (detached from) the burner proper, as in ported burners, yet not completely inside (captured within) the burner proper, as in most porous burners. In this invention the leading edge of the flame front remains within the fiber mat while a blue flame extends upwardly from the mat.

This partial attachment is suspected to give rise to the unique flame properties witnessed, which may have gone unnoticed until now because of how $NO_x$ emissions change during the transition from a blue flame to a radiant burner. Indeed the difference in emission characteristics appears not to have been an obvious question to ask or to experiment about by those experienced in the prior art of $NO_x$ control methods for natural gas combustion.

It is speculated that the controlling factors of the $NO_x$-reduction mechanism are:

A. Retracting the early portion of a blue flame into the top layer of a nested-fiber burner is suspected to affect, for the first time, the nascent chemistry of $NO_x$ formation, which occurs very early (promptly) in a natural-gas/air flame, and whose mechanism is governed by free radical production (chemistry) and high temperatures (physics).

B. Evidence that a chemical channel to $NO_x$ reduction must be active in the nested-fiber gas-burning process, thereby supplementing the physical channel and enhancing $NO_x$ reduction, rests with the fact that heat transfer between the flame and burner appear very little altered when the flame is partially withdrawn into the burner, that is, the flames are still blue and very hot, and the burner relatively cool.

At this writing, the mechanism by which the nested-fiber gas burner achieves low $NO_x$ emissions is not known with certainty. For the purpose of this patent, however, such information is not necessary. Nested-fiber gas-burner performance characteristics are not only related to nest characteristics, but also to interrelated use-specific characteristics, namely, operating parameters, such as fuel firing rate, fuel/air (equivalence) ratio, primary aeration, and excess aeration.

Experimental results indicate that the method for controlling a partially attached blue flame to a nested-fiber gas burner may be somewhat straightforward because of the relationship that nested fiber burners emit low $NO_x$ (<20 ppm) and low CO (<50 ppm) at high port loadings (0.8 to 5.3 KBtu/in.$^2$-hr) and short flame lengths (<2 in.) over fuel-lean equivalence ratios of about 0.5 to 0.9 when operated such that the velocity of the premixture of natural gas and air exiting the burner is about 1.5 times the fundamental burning velocity for that equivalence ratio.

The relationship is based on emerging evidence that the performance of the nested-fiber burner may not only be related to the existence and position of a blue flame, but also the size of the blue flame relative to the burner surface area. This relationship has implications regarding controls for the nested-fiber gas burner.

Looking now to FIG. 3, the "nest building" referred to above begins with the formation of fibers of a length and diameter which may or may not be uniform, but which will result in an aspect ratio in the range of about 15–50. Fiber dimensions to achieve this aspect ratio are described above and will not be repeated here. The step of forming fibers 40 is achieved by known procedures and the resulting fibers are deposited 42 in a mold of some predetermined shape to a depth in the range of about 0.3 in. to about 0.7 in. and preferably about 0.5 in. The fibers are randomly deposited to achieve the desired results, and no pressure whatsoever is applied to the fibers during the subsequent steps to form the resulting fibrous mat 22.

While within the mold, the fibers are heated 44 by any convenient means to a temperature in the range of about 1000° C. to about 1500° C. depending upon the melting point of the fibers. The intent is to heat the fibers and mold to the desired temperature and hold it there for about two hours to allow melt bonding of the fibers to each other such that when the heating cycle is completed, the fibers are bonded together to hold their form when they are installed in the burner body 12. Prior to placing the fibers in the mold they are washed in a solution of acetone and methylene chloride. The sintering takes place in a vacuum, the preferred pressure being about 0.001 atm.

The step of securing 46 the mat in the burner body may be effected by any conventional securing technology, and the step 48 of connecting body 12 to the gas source 28 is also a conventional step. Where the original sintering step takes place with the burner body serving as the mold, steps 44 and 46 are performed simultaneously.

It is not conventional to have an adjusting valve 34 in line 26 based on the parameters of void percentage, etc., for the purpose of holding the leading edge of the flame front in the fibrous mat. The enhanced heat transfer efficiency and the environmental benefits achieved were not previously known. Therefore, the adjusting step 50 of valve 34 takes place prior to actual use of the burner 10 in its operative position.

During the course of the aforementioned experimental tests, one additional unexpected and interesting feature was discovered. The fiber mat 22 cools extremely rapidly. After the igniting step 52 and following the burning of the gas/air mixture for a suitable period of time (for example, ten minutes), when valve 32 is closed 54, almost immediately the hand of the operator may be placed on the surface of mat 22 without blistering the skin. Skin blisters at surface temperatures greater than 55° C. Thus, a very interesting safety feature is achieved by the structure herein described. It is not known with certainty why the surface of the mat 22 returns to ambient temperature so quickly, but it is speculated that it is because of the small thermal mass of the mat combined with the fact that air continues to flow through the mat after the gas valve 32 has been closed and because the body 12 serves as a heat sink to some extent because of its mass. It will be understood that there is a temperature gradient within the mat 22 from (1) a temperature at surface 36 which will be only slightly above the combined ambient temperature from ambient air and gas source 28 and (2) the temperature which exists at surface 38 which is about 700° C. when the flame temperature is in the range of about 1200° C. to about 2000° C. Flame temperature depends upon the parameters built into the system by control valve 34 and the composition and void percentage of the fibers of mat 22. When operating in the blue flame mode, the upper surface 38 is at a temperature less than 700° C. and the surface 38 cools to less than 55° C. in less than two seconds.

The drawings illustrate the mat 22 being unsupported and unprotected at port 16. However, the mat itself may not have sufficient structural strength to resist deflections and distortions where a load is placed directly on the mat. Accordingly one or more diagonally extending bars may be installed across port 16 to provide structural support and minimize contact between foreign objects and the mat without changing the operating characteristics of the mat. Additionally, similar bars may be installed below mat 22 to prevent sag due to temperature cycling effects at the upper mat surface 38. It is doubtful that lower bars are necessary because the lower portion of mat 22 remains at about ambient temperature. Indeed, it is not envisioned that a load will ever be placed on mat 22 under normal operating conditions but support bars may be installed without changing operating characteristics.

The aspect ratio of the fibers making up mat 22 is critical to the system. Ratios in the range of about 15 to about 50 are operable. Note that the physical characteristic of aspect ratio is not a function of burner dimensions and with random fibers deposited in the sintering mold, the resulting porosity provides suitable gas flow and burning characteristics. Previously used gas burners using strands, fibers, wires or the like to form a flame support specified fiber diameter without any length specification. Other structures use wire meshes or screens with strands of a length to bridge the gas discharge opening without recognizing the aspect ratio concept. Where beads and ceramic grains are sintered to form a porous matrix for gas burners the resulting aspect ratio is about one and, in fact, is never mentioned because its significance is not known to be of importance. The combined characteristics of fiber length and diameter to give the desired aspect ratio results in a suitable porosity or void percentage to serve the needs of this invention. Aspect ratio combined with a suitable fiber metallurgical make up results in a suitable flame support to achieve the desired results, namely, a flame support to hold the leading edge of the flame front within the matrix formed and reduce nitrogen oxide and carbon monoxide emissions. The thickness of the sintered fiber mat is of importance to the extent that the leading edge of the flame front is not absolutely stationary because of gas-air mixture ratios, pressure variations and other minor physical variations which are inherent and continuous.

Having thus described the invention in its preferred embodiment, it will be clear that modifications may be made without departing from the spirit of the invention. Also the language used to describe the inventive concept and the drawings accompanying the application to illustrate the same are not intended to be limiting on the invention. Rather it is intended that the invention be limited only by the scope of the appended claims.

We claim:

1. A method of making a gas burner comprising, forming fibers of material having a diameter in the range of about 0.008 in. to about 0.03 in., a length in the range of about 0.3 in. to about 0.7 in. and an aspect ratio in the range of about 15–50, depositing said fibers randomly into a mold having a cross-sectional shape to a depth in the range of about 0.3 in. to about 0.7 in., heating said mold to a temperature in the range of about 1000° C. to about 1500° C. to effect a sintering of the fibers together to form a fibrous mat having said cross-sectional shape, providing a burner body with an inlet on one end and a burner port on the other end, and securing said mat in said burner port.

2. The method of claim 1 wherein said fibers are comprised of a material selected from the group consisting of stainless steel, iron-chromium-aluminum electrical-resistance alloys, nickel/chrome and FeCrAlY.

3. The method of claim 2 wherein said mat has a void percentage in the range of about 80% to about 89%.

4. The method of claim 1 wherein said mat has a void percentage in the range of about 80% to about 89%.

5. The method of claim 1 wherein the mold is heated to a temperature of about 1200° C.

6. The method of claim 1 wherein the fibers in the mold are heated for a period of about 2 hours.

7. A method of using a gas burner comprising, providing a burner body with an inlet on one end and a burner port on the other end, providing a fibrous mat for mounting in said port, said mat being formed by sintering fibers of a diameter in the range of about 0.008 in. to about 0.03 in., a length in the range of about 0.3 in. to about 0.7 in. and an aspect ratio in the range of about 15–50, said mat having a void percentage in the range of about 80% to about 89%, mounting said mat in said port to have inner and outer surfaces, connecting valve means to said inlet to (1) control the admission of a combustible gas and oxygen from a source to said body and (2) insure that the pressure of the gas and oxygen admitted to said body locates the leading edge of a flame front of said gas oxygen mixture which is ignited within said mat between said inner and outer surfaces.

8. The method of claim 7 including providing said mat to burn hydrocarbon gases at a temperature in the range of about 1200° C. to about 2000° C. and reducing the outer surface of said mat to a temperature below a temperature which will blister human skin within about 2 seconds of closing said valve means to stop the flow of said gas.

9. The method of claim 8 including providing said mat of a thickness in the range of about 0.3 in. to about 0.7 in.

10. The method of claim 9 including adjusting said valve means to limit gas to said burner only up to a port loading of about 5 KBtu/in.$^2$-hr and burning said gas such that the products of said burning include less than about 20 ppm of nitrogen oxides and less than about 50 ppm CO.

11. The method of claim 7 including providing said mat of a thickness in the range of about 0.3 in. to about 0.7 in.

12. The method of claim 11 including adjusting said valve means to limit gas to said burner only up to a port loading of about 5 KBtu/in.$^2$-hr and burning said gas such that the products of said burning include less than about 20 ppm of nitrogen oxides and less than about 50 ppm CO.

13. The method of claim 7 including adjusting said valve means to limit gas to said burner only up to a port loading of about 5 KBtu/in.$^2$-hr and burning said gas burning said gas such that the products of said burning include less than about 20 ppm of nitrogen oxides and less than about 50 ppm CO.

14. A burner for burning hydrocarbon gases comprising a hollow burner body with an inlet at one end and a port at the other end, a source of gas, a source of air, valve means connected in fluid communication between said gas source and said inlet, and a fibrous mat mounted in said port to support a flame when gas from said source is ignited at said port; said mat having interior and exterior surfaces, said valve means being adjusted to insure that ignited gas maintains the leading edge of a flame front within said mat between said surfaces, said mat having a void percentage in the range of about 80% to about 89%, the fibers of said mat have a aspect ratio in the range of 15–50;

said mat having the property of supporting the leading edge of said flame front within said mat while said flame is at a temperature in the range of about 1200° C. to about 2000° C. and cooling its outer surface of said mat to a temperature below a temperature which will blister human skin in a time period of less than about 2 sec. following a closing of said valve means.

15. The burner of claim 14 wherein the mat is formed of fibers having a diameter in the range of about 0.008 in. to about 0.03 in.

16. The burner of claim 15 wherein the mat is formed of fibers having a length in the range of about 0.3 in. to about 0.7 in.

17. The burner of claim 14 wherein said mat has a thickness in the range of about 0.3 in. to about 0.7 in. and when combined with said valve means provides a pressure drop across said mat of up to about 0.3 in. of water.

* * * * *